United States Patent [19]

Piribauer

[11] 3,943,304

[45] Mar. 9, 1976

[54] HEADPHONE OPERATING ON THE TWO-WAY SYSTEM

[75] Inventor: Herbert Piribauer, Wiener Neustadt, Austria

[73] Assignee: AKG Akustische u Kino-gerate Gesellschaft m.b.H., Austria

[22] Filed: June 12, 1974

[21] Appl. No.: 478,745

[30] Foreign Application Priority Data

June 19, 1973 Austria ..... 5406/73

[52] U.S. Cl. ..... 179/105; 179/111 E; 179/115.5 PS

[51] Int. Cl.[2] ..... H04R 23/02; H04R 1/22

[58] Field of Search ..... 179/105, 115.5 PS, 116, 179/111 R, 111 E, 156 R, 182 R, 182 A; 181/144

[56] References Cited

UNITED STATES PATENTS

| | | | |
|---|---|---|---|
| 2,615,994 | 10/1952 | Lindenberg et al. | 179/111 R |
| 2,922,851 | 1/1960 | Manley | 179/111 R |
| 3,008,013 | 11/1961 | Williamson et al. | 179/111 R |
| 3,158,697 | 11/1964 | Gorike | 179/115.5 PS |
| 3,632,903 | 1/1972 | Lange, Jr. | 179/111 R |
| 3,819,879 | 6/1974 | Baechtold | 179/182 |

OTHER PUBLICATIONS

Pages 61 & 62 from *AWA Technical Review*, Vol. 15, No. 2, Dec. 1973, from article "Application of Electrets to Electro–Acoustic Transducers", by R. E. Collins.

*Primary Examiner*—William C. Cooper
*Assistant Examiner*—George G. Stellar
*Attorney, Agent, or Firm*—McGlew and Tuttle

[57] ABSTRACT

The headphone comprises a low frequency transducer system and a high frequency transducer system, with the low frequency transducer system including an electrodynamic transducer. The high frequency transducer system includes an electrostatic transducer, and a supply transformer for the high frequency transducer system is mounted in the housing of the headphone. The two transducer systems are mounted coaxially of each other, with the high frequency transducer system being outwardly of the low frequency transducer system. The high frequency system may have a disc form or may have an annular form and, in the latter case, the inner diameter of the high frequency system corresponds to the outer diameter of the low frequency system which is received in a circular recess of the high frequency system. Also, the inner diameter of the annular high frequency system corresponds to the dimensions of a sound channel which, together with the cavity formed between the diaphragm of the low frequency transducer and the backside of the high frequency transducer, forms a Helmholtz resonator. For dividing the range of frequencies, acoustics and/or electrical elements are provided and are mounted in the housing of the headphone.

8 Claims, 9 Drawing Figures

HEADPHONE OPERATING ON THE TWO-WAY SYSTEM

FIELD AND BACKGROUND OF THE INVENTION

This invention relates to headphones operating on the two-way system, comprising a low frequency and a high frequency transducer system, with the low frequency system being an electrodynamic transducer, and, more particularly, the present invention is directed to an improved headphone of this type.

Headphones having earpieces equipped with two transducer systems, one for transmitting the high frequencies and the other for transmitting the low frequencies, are known, and have been designed so that the effect of a two-way system can be obtained by a particular arrangement of two electrodynamic transducers.

Since it is well known that electrodynamic transducers, in particular if used as sound generators, have a non-uniform frequency characteristic in the range of higher frequencies, the known solution represents only an improvement of headphones known up to the date and having a single system, while an ideal solution should provide also for a uniform radiation of the higher frequencies.

SUMMARY OF THE INVENTION

In accordance with the present invention, such an ideal solution is provided by having the high frequency transducer system designed as an electrostatic transducer, such as an electret-base electrostatic transducer, and the transformer, necessary for supplying the high frequency system, is mounted within the headphone.

Electret-base electrostatic transducers do not require a polarization voltage because this voltage is already impressed either on the diaphragm or on the back plate. Such transducers exhibit a high fidelity of reproduction and thus would be excellently suitable for headphones except for the necessity of supplying the same through a transformer. If dimensioned for the entire sound range to be transmitted, such a transformer necessarily would be of a size preventing its direct mounting in the headphone. Also, in an electrostatic transducer, it is difficult to achieve the oscillation amplitude of the diaphragm necessary for the bass response without great losses of efficiency, because of the needed large distance between the diaphragm and the back plate. To compensate such losses, high DC or AC voltages must be applied and such application results, however, in different complications.

On the contrary, if an electret-base electrostatic transducer operating as a sound generator is limited to the reproduction of medium and high frequencies, only a small transformer is needed, and such a small transformer can, in practice, be mounted without difficulty into any headphone, has virtually a constant transformation ratio completely satisfactorily transmitting the frequency range, and, moreover, is very inexpensive to manufacture. In view of the further fact that no large amplitudes occur at the medium and high frequencies, the spacing between the back plate and the diaphragm can be chosen so as to obtain the optimum efficiency.

On the other hand, in the higher frequency range, an electrodynamic transducer is less suitable for a headphone since, in the higher frequency range, the diaphragm no longer oscillates as a whole but tends to the formation of partial oscillations which are partly uncontrollable. This becomes apparent as an unsteady shape of the frequency characteristic in the range of about 1000 Hz. Below this frequency limit, however, the frequency characteristic of an electrodynamic transducer is considered satisfactory so that the combination provided, in accordance with the invention, of an electrodynamic transducer as a low frequency system and an electret-base electrostatic transducer as a high frequency system, appears most advantageous.

Various arrangements may be provided for positioning the electrostatic high frequency transducer. As it has to transmit only medium to high frequencies, the coupling volume between the external ear and the diaphragm of the transducer can be small. This is obtained, in accordance with the invention, by providing that, during use of the headphone, the electrostatic high frequency transducer practically is applied directly to the ear and is thus disposed in advance of the low frequency system. If a cavity is provided between the diaphragm of the low frequency system and the back of the high frequency system, the cavity can be extended into a Helmoholtz resonator by providing the corresponding sound exit ports. The arrangement then acts as a low-pass filter for filtering out all frequencies above 1,000 Hz., for example.

In the arrangement just mentioned, the high frequency system advantageously is designed in the form of a disc. However, if an electrostatic transducer with a greater sensitivity is provided, the diaphragm surface must be enlarged, and this can be done advantageously by providing an annular shape of the high frequency system.

By choosing the inner diameter of the annular high frequency system to be equal to the outer diameter of the low frequency system, the two transducers can be fitted one within the other, with the result of providing a particular flat construction. In such a case, however, it may become necessary to omit the cavity which, in the other embodiments, serves as a part of the acoustic low-pass filter. This drawback can be compensated if the two systems, for example, are electrically connected in series, by connecting a capacitor in parallel to the moving coil of the low frequency system and by correspondingly proportioning the transformer for the electrostatic high frequency system. Of course, other circuit arrangements are also possible.

A further possibility is to combine the above-described electric circuit arrangement with the acoustic arrangement for dividing the range of frequencies, or to use only one of them. Which arrangement is finally chosen depends upon the given requirements.

In the event a particularly high sensitivity of the electrostatic high frequency system is required, it is advantageous to provide this system in the shape of a disc which is formed with a central opening for the sound exit from the chamber which latter is formed between the low frequency diaphragm and the backside of the high frequency system.

An object of the invention is to provide an improved headphone operating on the two-way system.

Another object of the invention is to provide such a headphone in which the low frequency system includes an electrodynamic transducer and the high frequency system is designed as an electrostatic transducer.

A further object of the invention is to provide such a headphone in which the transformer necessary to supply the high frequency system is mounted within the headphone.

For an understanding of the principles of the invention, reference is made to the following description of typical embodiments thereof as illustrated in the accompanying drawings.

DESCRIPTION OF THE PREFERRED EMBODIMENTS

Figure 1:
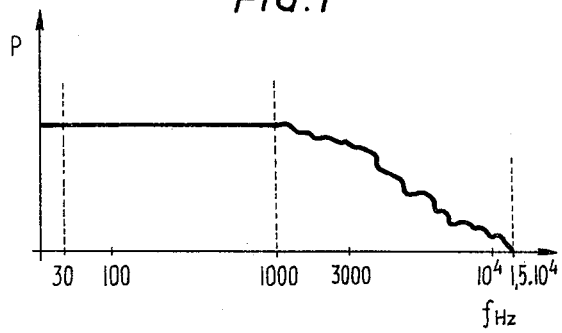
FIG. 1 is a diagrammatic illustration of the frequency characteristic of an electrodynamic transducer.

Referring to FIG. 1 showing the frequency characteristic of an electrodynamic transducer, such as used in headphones, it will be noted that the shape of frequency characteristic is excellently smooth and almost horizontal up to approximately 1,000 Hz. In the range above 1,000 Hz., however, the frequency response curve slopes downwardly and, in addition, exhibits relatively pronounced irregularity. From FIG. 1, it will be noted that an electrodynamic system is eminently and particularly suitable for the reproduction of frequencies below 1,000 Hz.

Figure 2:
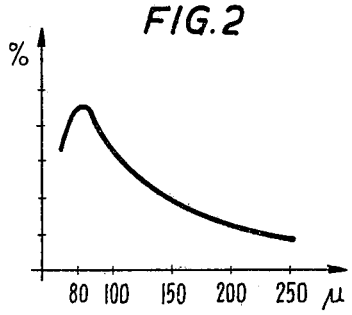
FIG. 2 is a diagrammatic representation of the efficiency of an electrostatic transducer as a function of the distance between the diagram and the back plate.

If an electrostatic system were to be used for the range of frequencies below 1,000 Hz., it would necessarily also have to be proportioned for the large oscillation amplitudes of the diaphragm at the low frequencies. In turn, this means a correspondingly large spacing between the back plate and the diaphragm which, however, as may be seen in FIG. 2, leads to a notable decrease in the sensitivity of the transducer system. On the contrary, if the electrostatic transducer, in accordance with the present invention, is reduced to operation in the higher frequency range, the optimum spacing of the electrodes can be maintained easily because of the much smaller oscillation amplitude of the diaphragm. In other words, the high frequency transducer used with the present invention operates in the associated range of frequencies with the best possible efficiency. The practical application of the foregoing conclusions is exemplified in a first embodiment of the invention as shown in FIG. 3.

Figure 3:
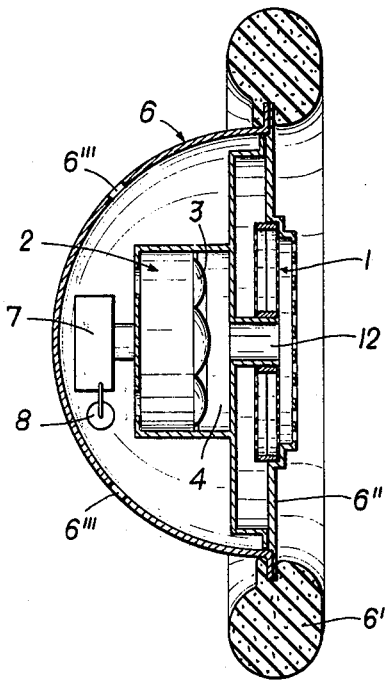
FIG. 3 is a diametric sectional view of a headphone, in accordance with a first embodiment of the invention, illustrating the principle of the invention.

Referring to FIG. 3, in a housing 6 which, as is customary at the present time, is designed in the form of a hemispherical cup having a border provided with a soft, elastic contact rim 6′, the two transducers 1 (high frequency system) and 2 (low frequency system) are located in a casing or case 6″ of plastic composition material. Electrostatic transducer 1 is disposed in advance of electrodynamic transducer 2, and the axes of the two tranducers are aligned in a common rectilinear line. Between the diaphragm 3 of low frequency system 2 and the back side of high frequency system 1, there is formed a cavity 4 communicating with the coupling space adjacent the transducer 1 through an opening 12. The volume of cavity 4 and the cross-section and length of opening 12 determine the critical frequency of a low-pass filter.

Aside from the two transducers, earpiece 6 contains a transformer 7 mounted therein for supplying high frequency transducer 1. Other control members or electrical component parts such as, for example, a capacitor 8 connected in parallel with the moving coil of low frequency system 2, may be mounted in housing 6, which may also be provided with openings 6‴ for permitting the sound exit, particularly in the lowest frequency range.

As mentioned above, the high frequency transducer may be provided in different shapes. Corresponding embodiments are illustrated in FIGS. 4 through 7. The embodiment shown in FIG. 4 corresponds substantially to that shown in FIG. 3. The low frequencies are radiated through passages 5 which are so dimensioned that, in cooperation with cavity 4, a continuous transition from the sound radiation of low frequency system 2 to the sound radiation of high frequency system 1*a* is obtained.

Figure 5:
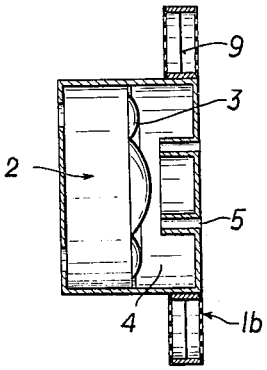

FIG. 5 shows an arrangement in which the electrostatic high frequency transducer 1*b* has an annular shaped and, in conformity therewith, also an annular diaphragm 9. The inner diameter of high frequency system 1*b* corresponds to the outer diameter of low frequency system 2, so that the two systems are interfitted with each other. A relatively small total height thereby may be obtained which, in some cases, is desirable. Since, in the embodiment of FIG. 5, it may become not possible to provide the cavity volume illustrated at 4 in FIG. 3, an electric dividing network advantageously may be used instead of the acoustic low-pass filter.

Figure 8:
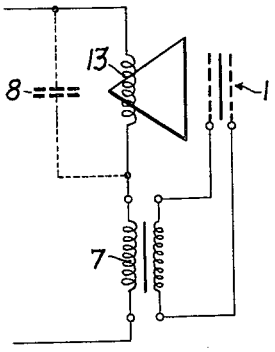
FIG. 8 is a schematic wiring diagram of an electric circuit arrangement for operating a headphone embodying the invention.

Such an electric dividing network is shown in FIG. 8, in which the primary winding of transformer 7 is connected in series with the moving coil winding 13 of the low frequency system. The low impedance of the primary winding constitutes no appreciable resistance for the low frequencies which, consequently, become practically fully effective at moving coil winding 13 of transducer 2. At the high frequencies, on the other hand, the primary winding of transformer 7 acts as an inductance coil so that a high voltage division ratio is produced between the transformer winding and the moving coil winding. To still further increase this ratio, the capacitor 8 may be connected in parallel with the low frequency system, as an addition.

Exactly the contrary applies to high frequency system 1. Due to the low impedance of the primary winding of transformer 7, the low frequencies pass to the electrostatic transducer to only an insignificant extent, so that their effect is practically negligible. For the higher frequencies, on the other hand, the transformer is dimensioned so that these frequencies are fully applied to high frequency system 1. Capacitor 8, if provided, prevents any disturbing effect which may be produced by the impedance of moving coil winding 13 of the low frequency system, at the high frequencies.

Figure 4:
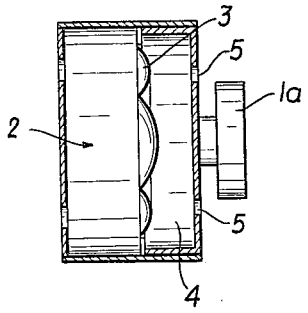
FIGS. 4 through 7 are sectional views illustrating different embodiments of the assembly of an electrostatic high frequency system with an electrodynamic low frequency system.

The circuit arrangement shown in FIG. 8 is, of course, not limited to the embodiment of FIG. 4, as it may also be used together with the acoustic low-pass filter 4, 5 of FIGS. 3, 4, 6 and 7.

Figure 6:
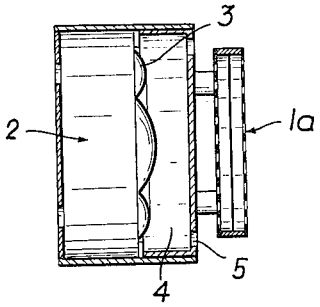

In the embodiment of the invention shown in FIG. 6, high frequency transducer 1*a* has practically the same diameter as low frequency transducer 2. However, if cavity 4 with openings 5 is to be designed as a low-pass filter, a corresponding gap must be left free for these openings 5.

Figure 7:
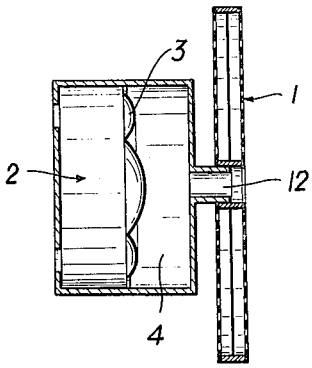

As shown in FIG. 7, high frequency transducer 1 also may have a larger diameter than low frequency transducer 2. Such a solution would be chosen particularly if a high sensitivity of the high frequency system is desired, or if it is desirable to manage with the transformer 7 having a relatively small transformation ratio. In the embodiment of FIG. 7, high frequency transducer 1 is designed as a disc-shaped body having central opening 12 which performs the same functions as openings 5 provided in the previously described embodiments.

Figure 9:
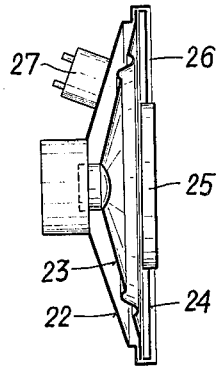
FIG. 9 is a view illustrating a combination of a dynamic miniature loudspeaker with an electret-base high frequency transducer.

A combination of a miniature dynamic loudspeaker with an electret-base high frequency transducer and an associated transformer is illustrated in FIG. 9. Diaphragm 23 is fixed in a basket 22. A supporting plate 24 carries electret-base transducer 25 and is formed with sound openings 26. Transformer 27 is mounted on basket 22 and transforms the AC voltages to the level necessary for electret-base transducer 25.

The substantial improvement of the headphone in accordance with the invention as compared to prior art headphones resides not only in the utilization of the favorable behavior of the dynamic system in the range of low frequencies and in the obtained highly accurate conversion of transient oscillations of the high frequency transducer diaphragm subjected to surface pressure variations, but also in that the transformer for the electrostatic system is very inexpensive as compared to that required for a capacitor transducer covering the entire transmission range. The reason for this is that the transformer has to be dimensioned for only the high frequencies, and a very small core volume as well as a very small number of turns is sufficient.

The invention further makes it possible to ensure, with very modest means, the security conditions for an earpiece containing an electrostatic transducer, and to mount the necessary transformer into the headphone.

While specific embodiments of the invention have been shown and described in detail to illustrate the application of the principles of the invention, it will be understood that the invention may be embodied otherwise without departing from such principles.

What is claimed is:

1. In a headphone operating on the two-way system, comprising a low frequency transducer system and a high frequency transducer system, with the low frequency tranducer system including an electrodynamic transducer, the headphone including a housing arranged to be engaged with the external ear of the user, the improvement comprising, in combination, an electrostatic transducer transmitting only high frequencies and constituting said high frequency transducer system; and a supply transformer, having a very small core volume and a very small number of turns, for supplying only said electrostatic transducer system, mounted within said housing.

2. In a headphone operating on the two-way system, the improvement claimed in claim 1, in which said high frequency system has the form of a disc and is disposed coaxially of said low frequency system.

3. In a headphone operating on the two-way system, the improvement claimed in claim 1, in which said high frequency system has an annular form.

4. In a headphone operating on the two-way system, the improvement claimed in claim 3, in which the inner diameter of the annular high frequency system corresponds to the outer diameter of the low frequency system; said high frequency system having a circular recess receiving said low frequency system.

5. In a headphone operating on the two-way system, the improvement claimed in claim 3, in which the inner diameter of said annular high frequency system corresponds to the dimensions of a sound channel forming, together with a cavity formed between the diaphragm of the low frequency transducer and the back side of the high frequency transducer, a Helmholtz resonator.

6. In a headphone operating on the two-way system, the improvement claimed in claim 1, including acoustic elements mounted in the headphone for dividing the range of frequency.

7. In a headphone operating on the two-way system, the improvement claimed in claim 1, including electrical elements mounted in the headphone for dividing the range of frequencies.

8. In a headphone operating on the two-way system, the improvement claimed in claim 1, in which said low frequency transducer system comprises a miniature dynamic loudspeaker; said electrostatic transducer comprising an electret-base high frequency transducer.

* * * * *